US005724847A

United States Patent [19]

Hite

[11] Patent Number: 5,724,847

[45] Date of Patent: Mar. 10, 1998

[54] INTEGRATED WIRE FEED AND DRAW APPARATUS

[75] Inventor: William H. Hite, Tiffin, Ohio

[73] Assignee: The National Machinery Company, Tiffin, Ohio

[21] Appl. No.: 653,669

[22] Filed: May 31, 1996

[51] Int. Cl.[6] ..... B21C 1/20; B21C 1/28

[52] U.S. Cl. ..... 72/285; 72/290; 72/291; 226/150; 226/162

[58] Field of Search ..... 72/290, 291, 285, 72/287; 226/162, 167, 150, 149, 147

[56] References Cited

U.S. PATENT DOCUMENTS 4,942,796 7/1990 Dom et al. ..... 83/72

FOREIGN PATENT DOCUMENTS 0 596 577 1/1997 European Pat. Off. .

OTHER PUBLICATIONS

Nedschroef Feed/Wire Drawer Mechanism Sketch.
Nedschroef/Nedschroef Herentals N.V. Brochure.

*Primary Examiner*—Daniel C. Crane

*Attorney, Agent, or Firm*—Pearne, Gordon, McCoy & Granger LLP

[57] ABSTRACT

Apparatus for feeding and optionally drawing wire to a forging machine or the like. The apparatus is a compact unit that conserves floor space and offers manufacturing economies by permitting the use of common components whether or not the optional drawing feature is selected. Large hydraulic clamping forces for wire drawing operation are developed by a relatively large piston and cylinder that operates mechanically through a relatively small piston and cylinder. The relatively small piston and cylinder enables the apparatus to quickly grip and release wire stock to achieve high machine speeds. When the draw option is not selected, the relatively large piston and cylinder are not supplied, but otherwise most of the same components including the small high speed piston and cylinder are retained to reduce the number of different parts used in the manufacture of the apparatus. The apparatus includes an open top frame and gripper design that permits simplified loading of a new length of stock and removal of any remnant.

21 Claims, 8 Drawing Sheets

21
61
59
6
59
56
21
63
57
5
63
61
62
19
28
29
30
27
26
6
29
27
30
28
26
5
67
128
125
129
130
126
127
147
125
21
21

INTEGRATED WIRE FEED AND DRAW APPARATUS

The invention relates to a wire feed mechanism for accurately feeding a measured length to a forging machine and which has wire drawing capability.

PRIOR ART

Commonly, stock feed mechanisms for forging machines having utilized feed rollers to feed wire or bar stock to the machine. The accuracy with which a length of wire is fed with a roll feed can be limited by the surface condition of the wire as well as other variable factors. An improved type of grip feeder is disclosed in U.S. Pat. No. 4,942,796 assigned to the assignee of the present invention.

In general, drawing of wire stock being fed to a forging machine has been accomplished with apparatus that is separate from the wire feed mechanism. Consequently, in the past, wire drawing apparatus has added its proportionate cost to a forging machine installation as well as a demand for additional floor space. Prior wire drawing equipment takes significant time for a changeover of wire size when any remnant of a coil has to be removed and a new coil end has to be threaded through the apparatus. These efforts add to the total required changeover time.

SUMMARY OF THE INVENTION

The invention provides a wire feeding apparatus for forging machines that employs a cooperating set of movable and stationary grips or jaws. The apparatus is arranged to incorporate, as a basic option, a draw die to size the wire being fed. The organization of the wire path, gripping jaws and related actuators allows any stock remnant or unused portion of a coil to be removed from the apparatus and a new coil or bar to be loaded with reduced time and effort as compared to earlier systems particularly where wire drawing and feeding was accomplished in separate devices.

In the disclosed apparatus, the gripping forces are developed by hydraulic actuators. The stationary set of grips are arranged to sustain the drawing forces when this option is elected. The gripping forces for drawing are developed by a pair of tandem hydraulic actuators. One of the actuators, with a relatively small cross sectional area, clamps and unclamps the wire in a short time to achieve high speed operation. The other actuator, with a relatively large cross section to generate a large clamping force, operates through a longer actuation time period. The tandem relationship of the hydraulic actuators, where the large actuator mounts at an end of and operates through the smaller actuator simplifies the manufacture of the wire feed apparatus with the option of a draw die attachment and permits reductions in manufacturing and inventory costs.

The movable grips are driven for feeding motion by a cam preferably connected to the main drive of the associated forging machine. The cam has a relief area in its profile so that after a working stroke of the draw die the tension in the wire is unloaded before the movable grip is engaged with the wire. This unloading or relief of the wire improves feeding accuracy.

The framework of the feeding and drawing apparatus is open from the top and the grips are arranged to open and close in a horizontal plane so that stock can be quickly and efficiently loaded and unloaded, i.e. laterally of the feed direction, vertically in and out of the apparatus.

DESCRIPTION OF THE PREFERRED EMBODIMENT

Figure 1:
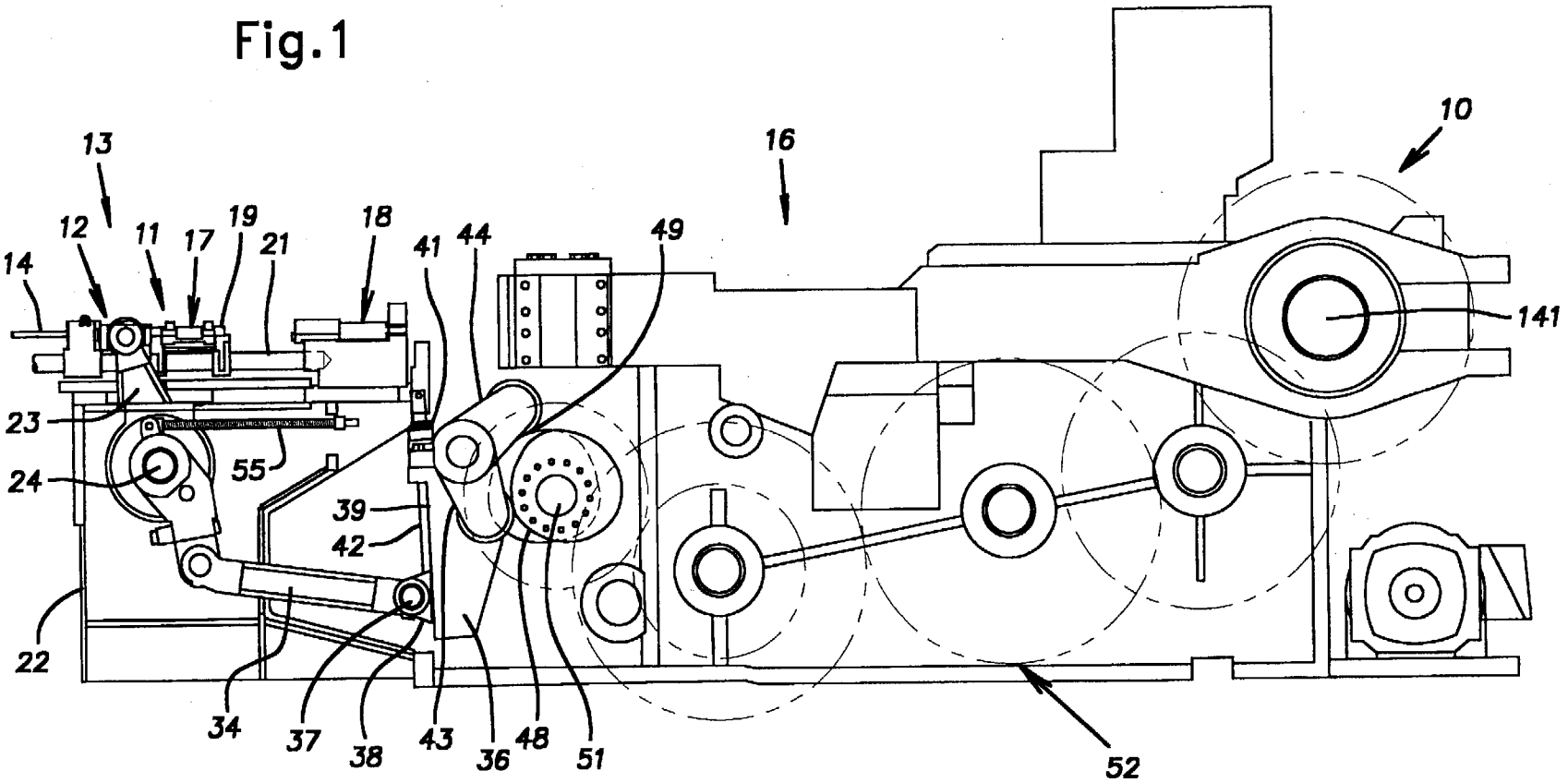
FIG. 1 is a somewhat schematic side elevational view of a wire feeding and drawing apparatus and an associated forging machine.

A forging machine 10 has a stock feed device 11 and an optional wire drawer device 12 in a combined apparatus 13. The apparatus 13 feeds stock supplied to it as wire in a coil or bars of limited length. The apparatus 13 feeds incremental lengths of the stock, designated 14, from left to right as viewed in FIG. 1 to a cut-off or shear station 16, known in the art, where lengths of the stock corresponding to the feed stroke of the apparatus 13 are cut into workpieces or blanks. From this station 16 such workpieces are transferred to successive die stations where they are progressively formed into desired shape. Reference can be made to U.S. Pat. No. 4,910,993, the disclosure of which is incorporated herein by reference for a disclosure of other details of the forging machine.

Figure 2:
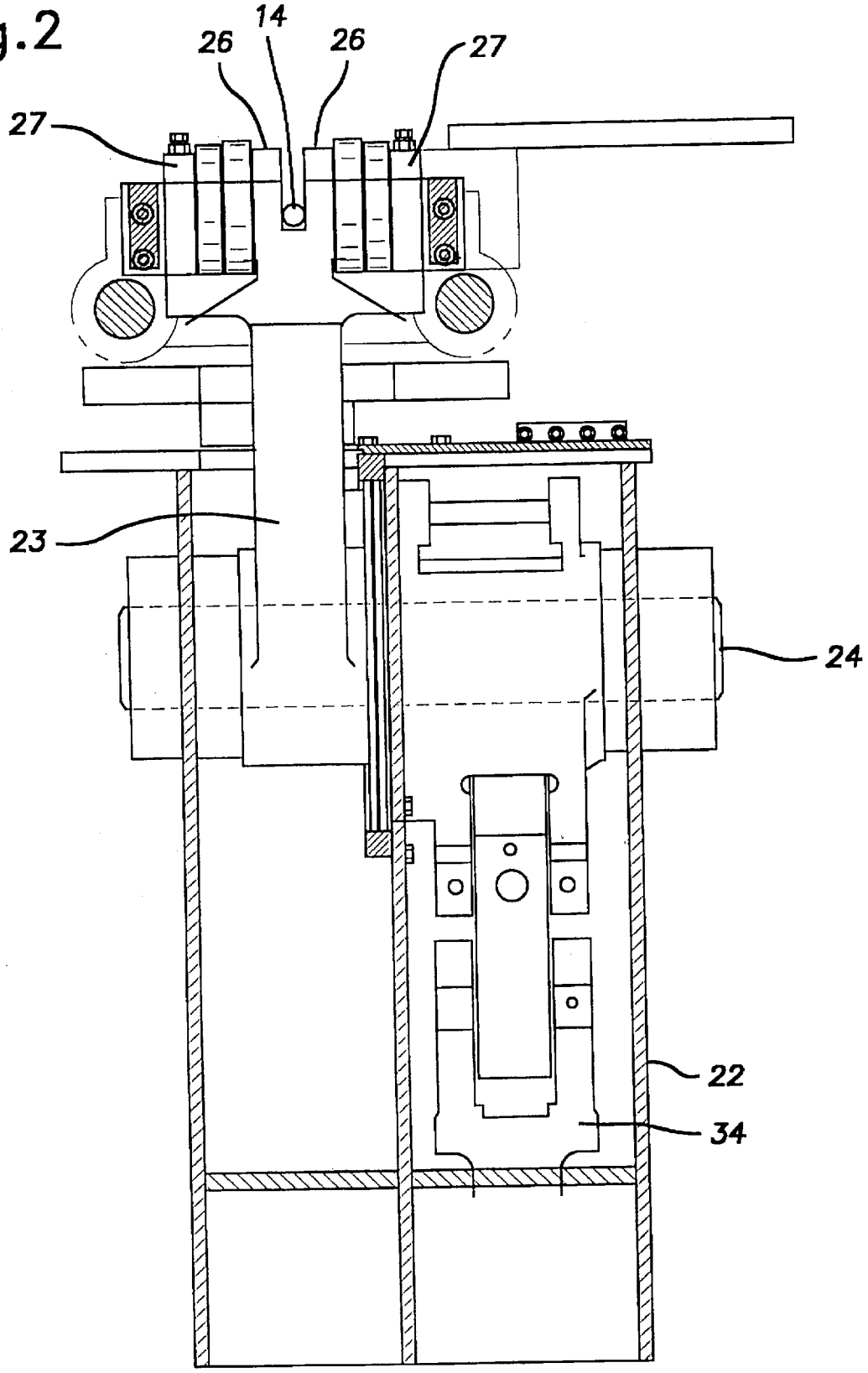
FIG. 2 is a partially sectional view, looking in the direction of wire feed, of the wire feeding and drawing apparatus.

The stock feed device 11 of the apparatus 13 includes a movable set of grippers 17 and a stationary set of grippers 18. The movable grippers 17 grip and then advance the stock 14 towards the stationary grippers 18 which grip the stock at times when it is not being fed. The movable grippers 17 are assembled on a carriage 19 that travels on a pair of parallel rails 21 fixed on a framework 22 of the apparatus 13. The carriage 19 is driven horizontally back and forth on the rails 21 by a generally vertical lever 23 pivotally supported on a pin 24 carried by the framework 22. The upper end of the lever 23 is doubly forked with pairs of tines 26, 27 (FIG. 2) forming trunnions for individual coaxial shafts 28 spaced apart on both sides of the stock 14. Assembled on each of the shafts 28 are a set of rollers 29, 30, one roller 29 being slightly larger than the other roller 30. A lower end of the lever 23 is coupled with a pin to a connecting rod 34. The other end of the connecting rod 34 is coupled to a drive lever 36 by a pin 37 carried on a block 38. The block 38 is coupled to the drive lever 36 by interengagement with a generally vertical slide 39 formed on the drive lever. A motor/resolver 41 operates a screw 42 engaged with the block 38 in such a manner that rotation of the screw 42 imparted by the motor/resolver 41 moves the block 38 carrying the pin 37 to a desired location along the length of the slide 39. The motor resolver 41 is operated by a master controller for the machine 10. The position of the block 38 on the slide 39 regulates the length of the feed stroke of the carriage 19 and movable grippers 17.

The drive lever 36 is pivotally oscillated by a set of rocker arms 43, 44 each of which has a roller that follows complementary profiles of a pair of cams 48, 49 rotatable with a feed camshaft 51. In the illustrated case, the cam 48 is a "feed" cam producing motion of the lever 36 that results in rightward motion of the carriage 19 (FIG. 1). The other cam 49 produces positive leftward motion of the carriage 19. Compression springs 55 bias the various feed drive elements to reduce the effects of any clearances on feed stroke accuracy. The feed camshaft 51 is positively driven in synchronization with the operating cycle of the forging machine 10 through a gear drive train 52.

The descriptive adjectives "movable" and "stationary" applied to the sets of jaws 17, 18 refer to their capacity for movement or lack of movement, respectively, along the direction of feed of the stock 14. It will be understood, however, from the following description, that each of these sets of grippers 17, 18 has at least one gripper element that is movable in a horizontal plane in a direction transverse to the feed direction for gripping and ungripping action. The movable set of grippers 17 comprise a pair of elongated horizontally opposed blocks 56, 57. Opposed stock gripping faces of the blocks include longitudinally extending V-grooves 58 for engaging the surfaces of the stock 14. The profile of the grooves 58 can have a configuration other than the shape of a V, such as a circular segment or converging arcuate segments to accommodate different stock or wire materials. Each of the blocks 56, 57 is between a respective pair of V-grooved rollers 59. The rollers 59 are each on vertical axles 61 assembled in slots 62 that permit limited movement of such axles and rollers 59 in a horizontal direction. Compression springs, shown in phantom at 63, bias the rollers 59 towards a central plane between the blocks 56, 57.

Figure 5:
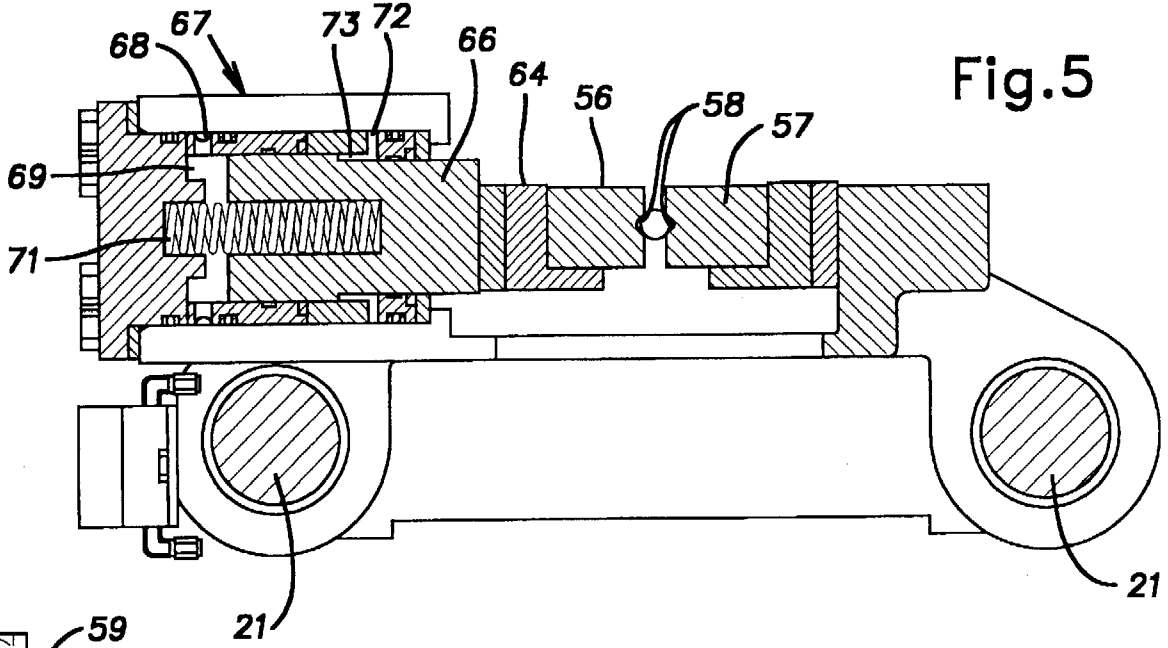
FIG. 5 is a cross-sectional view, taken in the plane 5—5 indicated in FIG. 4, of the moveable set of grippers, and an associated hydraulic actuator.
Figure 6:
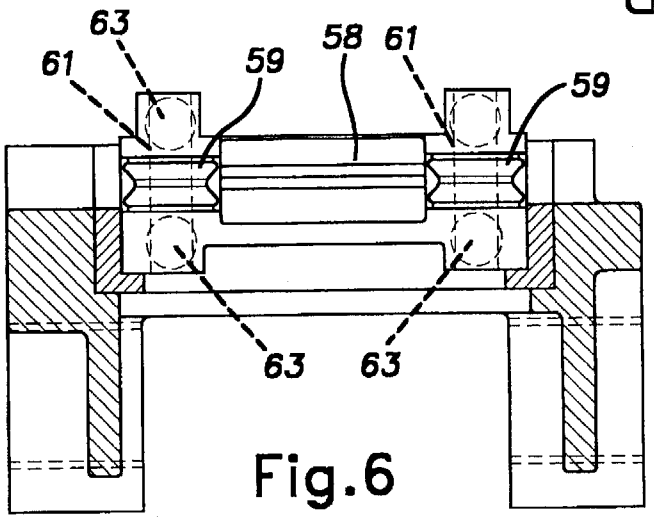
FIG. 6 is a cross-sectional view, taken in the plane 6—6 indicated in FIG. 4, of one of the moveable grippers.

A displaceable one of the blocks 56 is attached through a mounting block 64 to a piston 66 of a hydraulic cylinder actuator 67 (FIG. 5). Hydraulic pressure applied to a chamber or bore 69 through a port 68 forces the piston 66 and displaceable block or gripper 56 towards the opposed gripper block 57. This hydraulic clamping force readily overcomes the biasing forces of the springs 63 on the rollers 59 and results in the gripper blocks 56, 57 engaging and tightly holding the stock 14. When the port 68 is connected to a vent, such as a reservoir, the springs 63 cause the displaceable block 56 to retract slightly from the stock and thereby release it. A spring 71 centrally disposed in the piston 66 and weaker than the springs 63 prevents the piston and, therefore, the block 56, from drifting any appreciable distance away from the stock 14. It will be understood that stock 14 of different diameter can be accommodated by the illustrated blocks 56, 57 because of the capacity of the piston 66 to operate in different axial positions in the bore 69, depending on the diameter of the stock. It will further be understood, however, that for clamping and unclamping a given diameter of stock, the piston 66 need only move a distance corresponding to the clearance in the slots 62 with the vertical axles 61. A port 72 allows hydraulic pressure to be selectively supplied to an annular chamber 73. When hydraulic pressure is applied in this chamber 73, and the chamber 69 is vented, the piston 66 retracts a full distance moving the block 56 considerably away from the block 57 for purposes of changing the stock.

Figure 7:
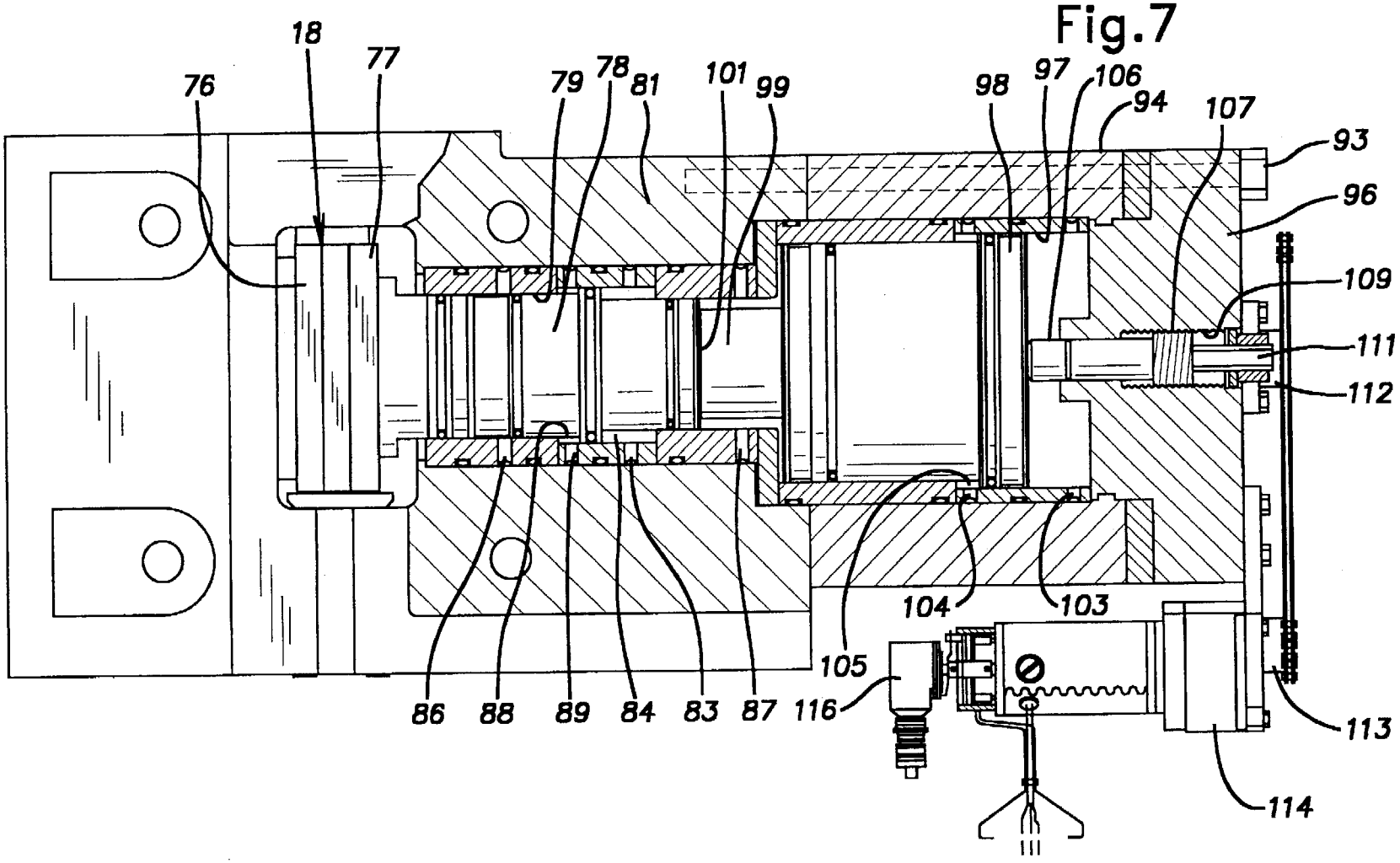
FIG. 7 is a cross-sectional view taken in a horizontal plane of a stationary set of grippers and associated hydraulic actuators.

FIG. 7 illustrates the stationary set of grippers 18 and related hydraulic actuators for the combined apparatus 13 for drawing and feeding wire. The grippers 18 include a horizontally extending fixed block 76 and an opposed displaceable block 77. The blocks 76, 77, like the blocks 56, 57, can have V-grooves on their opposed working faces to grip the stock 14. The displaceable gripper block 77 is carried for clamping and unclamping movement on a first relatively small clamping piston 78. The clamping piston 78 moves axially in a bore or cylinder 79 in a horizontal plane perpendicular to the line of movement of the stock 14. The bore 79 is located in an associated housing 81 mounted on the framework 22. High pressure hydraulic fluid is applied to a port 83 and an annular chamber 84 to extend the piston 78 from the cylinder 79 to move the displaceable block 77 towards the fixed block 76. Vents 86, 87 are connected to the hydraulic tank or reservoir associated with a hydraulic circuit (not shown) conventionally including a hydraulic pump. The piston 78 is continuously biased to a retracted position to the right in FIG. 7 with a small hydraulic force developed by hydraulic pressure in an annular chamber 88 through a port 89.

Bolted to the housing 81 by a plurality of bolts 93 is an auxiliary housing 94 and an end plate 96. Within the auxiliary housing 94 is a bore 97 coaxial with the bore 79 and cooperating with a relatively large piston 98. The piston 98 includes an integral extension 99 adapted to abut a rear face 101 of the smaller piston 78. High pressure hydraulic pressure is supplied to a port 103 to drive the large piston 98 to a stock gripping position, to the left in FIG. 7. When the port 103 is exhausted, a constant supply of high pressure hydraulic fluid applied to a port 104 and an annular chamber 105 causes the large piston 98 to move to the right in FIG. 7 to unclamp stock.

The retracted or rightward position of the large piston 98 is adjustable in relation to the diameter of the stock 14 by action of a stop pin 106. The stop pin 106 has external threads 107 engaging complementary threads in an axial bore 109 in the end plate 96. An extension 111 of the stop pin 106 is externally keyed or splined to be rotationally driven by a sprocket 112 while relative axial movement between these elements is accommodated. The sprocket 112 is driven through a chain by a smaller sprocket 113 attached to the output shaft of a motor/gear box 114 selectively operated by the master controller of the machine. An electronic encoder 116 monitors the rotation of the motor/gear box 114 and therefore, as will be understood by those skilled in the art, the axial position of the stop pin 106.

Figure 3:
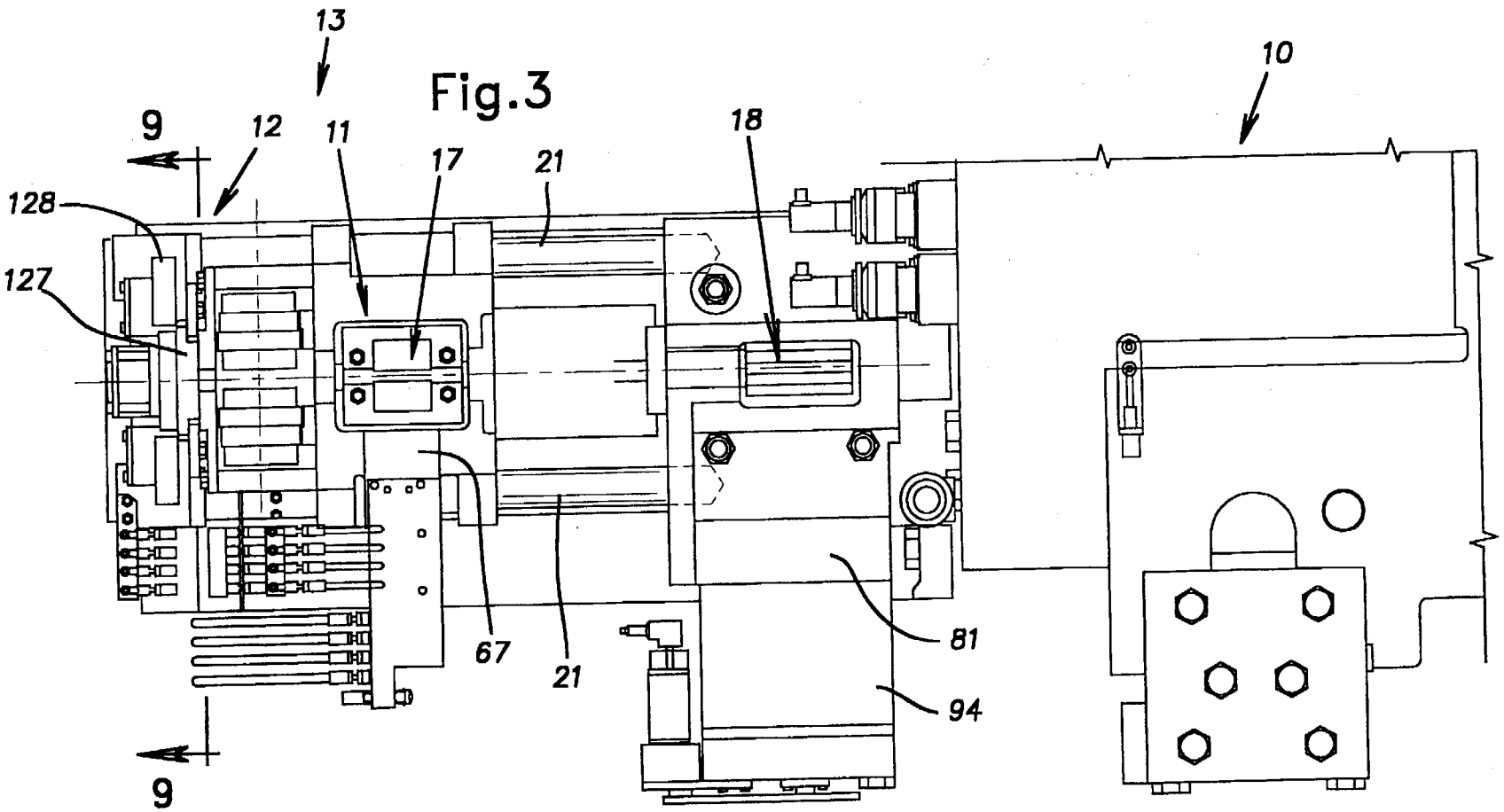
FIG. 3 is a plan view of the wire feeding and drawing apparatus.
Figure 4:
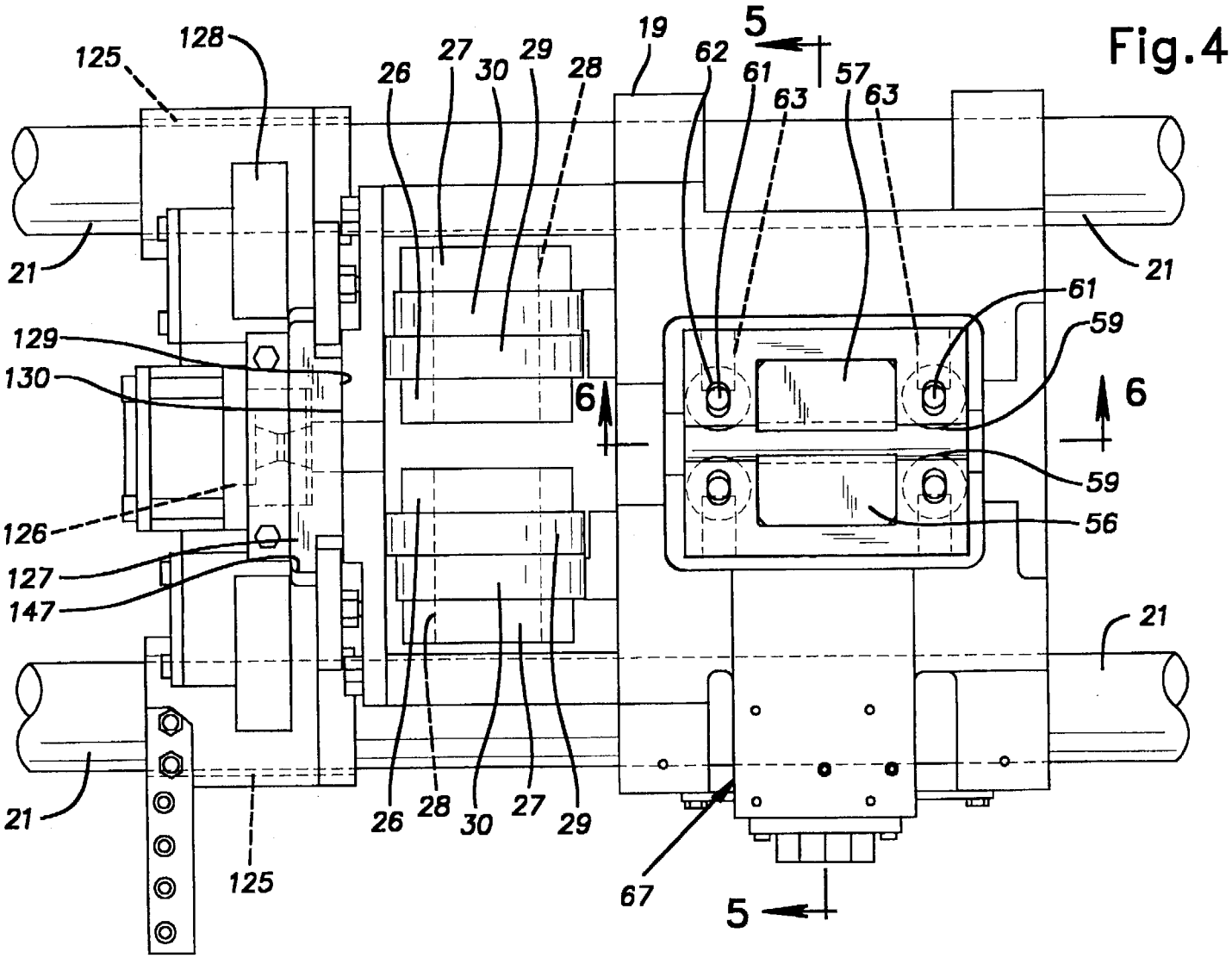
FIG. 4 is a plan view of a moveable set of grippers and a draw die area of the apparatus.

A draw die 126, generally known in the art, is carried in a cassette 127 which, in turn, is clamped in an associated carriage 128. The carriage 128 has bushings 125 that slide on the rails 21. As shown in FIG. 3, for example, the movable set of grippers 17 and its associated carriage 19 lie between the stationary set of grippers 18 and the draw die 126 and its associated carriage 128. The draw die cassette 127 has an abutment face 129 adapted to contact a rear face 130 of the carriage 19. A powered pusher, known in the art, (not shown) can be used to thread the lead end of a piece of stock 14 through the die 126 and into the zone of the moveable set of grippers 17. A rotary encoder of known construction, not shown, is attached to the drive train and continuously signals the machine's master controller of the angle of the crankshaft 141 so that the controller monitors the instantaneous phase of the machine cycle being performed.

Operation of the machine 10 is now described. With each revolution of the crankshaft 141 the machine 10 performs a full working cycle. The feed camshaft 51 rotates in synchronization with the crankshaft 141 causing the cams 48, 49 to rotate in synchronization with motion of the heading slide driven by the crankshaft 141. The feed cam 48 causes the rocker arm 43 to swing the drive lever 36 and lever 23 clockwise as viewed in FIG. 1. In turn, the rollers 30 forcibly move the carriage 19 to the right in FIG. 1. As discussed, the vertical position of the block 38 on the slide 39 of the drive lever 36, under the control of the master controller determines the length of the feed stroke of the carriage 19. During the feed stroke of the carriage 19, the movable set of grippers 17 are closed tightly against the stock 14 by pressurization of the port 68 so that the stock 14 is forcibly moved with the stroke of the carriage.

At the end of the feed stroke of the carriage 19, produced by the feed cam 48, the master controller activates a valve to pressurize the small clamping piston 78 of the stationary set of grippers 18. At the same time, the controller actuates a valve to supply high pressure hydraulic fluid to the cylinder of the large piston 98. The small clamping piston 78 is extended from its cylinder in a relatively short time, say for example, 25 milliseconds to cause its associated gripper block 77 to press the stock 14 against the opposing block 76 to establish control of the position of the stock. Once the small piston 78 causes the gripper blocks 76, 77 to adequately grip the stock, the master controller operates to exhaust the hydraulic cylinder 67 through the port 68 and release the clamping action of the moveable gripping block 17. The large piston 98 is slower to act than the small piston 78 owing to the relatively large volume of oil required to be displaced in its cylinder. Typically, the large piston 98 will require twice the time, for example, 50 milliseconds, to react and produce a clamping load. The heavy clamping load produced by the large piston 98 is applied through the extension 99 to the rear face 101 of the small piston 78 and through the small piston ultimately to the gripping block 77. In this connection, the importance of the function of the stop pin 106 can be understood. The stop pin 106 is axially adjusted so that when both pistons 78 and 98 are retracted to the right in FIG. 7, sufficient clearance exists between the blocks 76, 77 to allow for passage of the stock 14 therebetween. However, the stop pin 106, when adjusted by the master controller through the motor/gear box 114 and encoder 116 does not let these pistons retract any further than is necessary for feeding clearance of the stock. Consequently, the large piston 98 need only travel a relatively small distance corresponding to that dictated by a practical working clearance for feeding stock during the feed stroke. When the large piston 98 is to be fully retracted for purposes of changing stock, for example, the machine controller causes the motor/gear box 114 to back the stop pin 106 out to a fully retracted position.

From the foregoing discussion, it will be understood that the disclosed tandem arrangement of the small clamping piston 78 and the large clamping piston 98 offers a quick clamp response, accomplished by the small piston in a relatively short time, and a very large clamping force accomplished by the large piston at a subsequent time. The quick initial clamping response of the small piston 78 allows for a high operational speed of the machine 10 since the movable gripper set 17 can be released at an early stage as soon as the small piston 78 of the stationary gripper set 18 has taken control of the stock. The draw cam 49 on the feed camshaft 51 has a profile timed to begin the return of the carriage 19, to the left in FIG. 1, after the movable set of grippers 17 is released.

It will be understood that the draw die carriage 128 previously followed the gripper carriage 19 during the earlier feed stroke because the interference forces between the stock 14 and the draw die 126 are greater than the frictional forces on the draw die carriage resisting movement along the rails 21. During return movement of the gripper or feed carriage 19, the abutment face 129 is contacted by the rear face 130 of the feed carriage and the draw die carriage 128 is positively driven in the direction opposite the stock feed direction. The draw die 126 is thus pushed over the stationary stock 14. At this time, the large piston 98 is applying a high hydraulically developed clamping force on the stock 14 at the stationary set of grippers 18.

The draw die cam 49 has its profile arranged such that immediately after the carriage 19 and draw die 126 reach their rearwardmost or retracted position, these elements are relieved so that there is substantially no tension in the length of stock between the stationary and movable sets of grippers 18, 17. This relief, allowed by the draw cam profile and exhibited by slight forward movement of the gripper carriage 19 in the feed direction eliminates potential sources of feed length error by eliminating strain in the various levers and other machine elements as well as eliminating the risk that the grippers 17, 18 would allow the stock to slip when these members are being clamped or unclamped and there could otherwise be a high tensile load in the stock created by the drawing process. The moveable gripper set 17 is unclamped during this relief phase.

After the elements of the apparatus 13 are relieved by the profile of the draw cam 49 as described, the clamping cylinder 67 of the movable gripper 17 is pressurized with hydraulic fluid and, simultaneously, the large clamping cylinder or bore 97 is exhausted by the associated valves under the control of the master controller. In accordance with the invention, when the large clamping piston 98 of the stationary grippers 18 is begun to be released, the stock is safely held stationary by the tandem small clamping piston 78. Only after the piston 66 of the movable gripper set 17 has applied full gripping force on these grippers, is the small piston 78 of the stationary gripper set 18 released. From the forgoing, it will be understood that the small hydraulic piston 78 of the stationary gripper set 18 maintains positive clamping of the stock 14 during the time period that the large piston 98 is initially being released. The two stage release of the pistons 98 and 78 allows high speed machine operation since the large piston 98, which takes a relatively long period to exhaust can be vented relatively early in the unclamping cycle while the smaller piston 78 serves to clamp the stock and can then be quickly exhausted. Thereafter, with the actuator chamber 69 of the movable gripper set 17 energized to clamp onto the stock, the apparatus is set to begin a new feed stroke cycle.

The various described components of the stock feed device 11 and wire draw device 12 are sized and configured to sustain the drawing forces developed as the draw die 126 is forcibly pushed over the stock 14 when the movement of the carriage 19 is reversed. However, the stock feed device 12 can be provided on the forging machine 10 without the optional wire draw device 12 to reduce cost where wire drawing is not needed.

Figure 8:
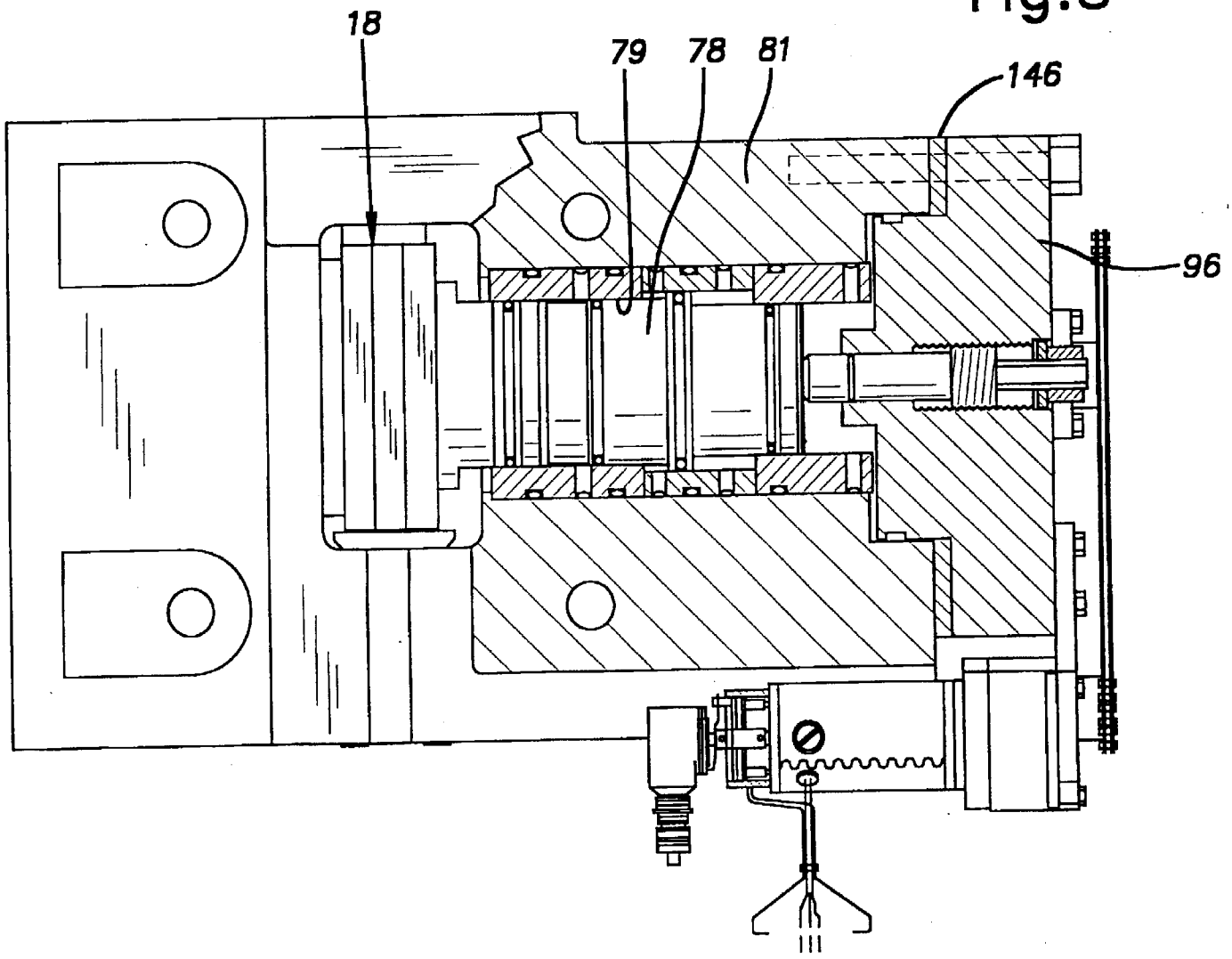
FIG. 8 is a view similar to FIG. 7 illustrating an arrangement where the wire draw option is not provided.
Figure 9:
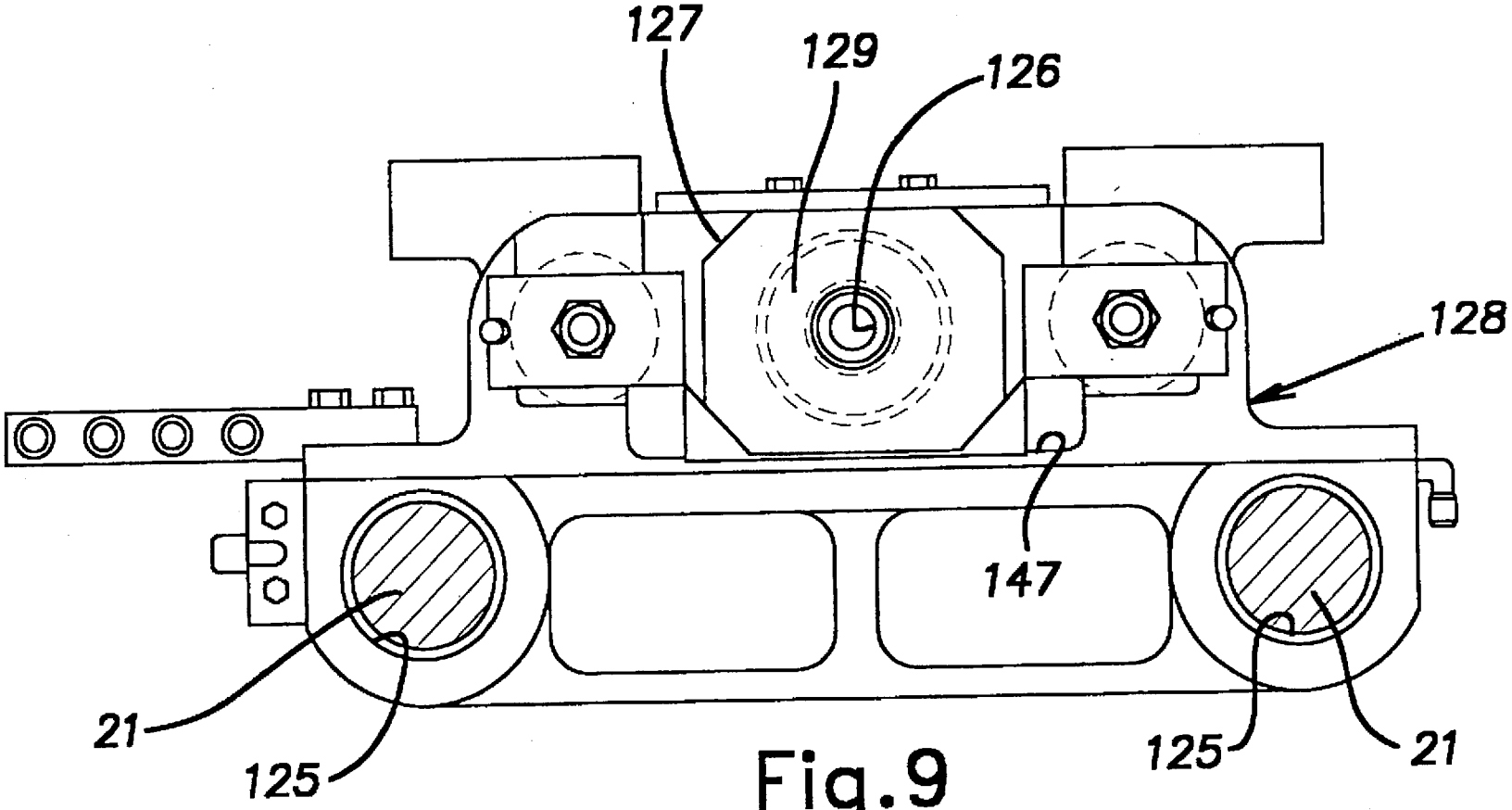
FIG. 9 is a view, taken in the plane 9—9 indicated in FIG. 3, showing a draw die carriage.

When the wire draw option is not provided, the large piston 98 and its associated hardware is omitted. FIG. 8 illustrates the configuration of the stationary grip section of the stock feed device in this case. Identical numerals are used in FIG. 8 where the parts identified are the same as those of FIG. 7. As shown, in this configuration, the end plate 96 is bolted to the housing 81 with an intermediate adapter plate 146. Besides the omission of the large clamping piston 98, the draw die 126 and related hardware such as the carriage 128 are, of course, also omitted. The various remaining parts operate substantially the same as they do in the combined apparatus 13 described in connection with FIGS. 1 through 7 except that the relief action of the equivalent of the draw die cam may be omitted.

The wire feeding and drawing apparatus 13 is organized in such a manner that the area above the die cassette 127, moveable gripper set 17, and stationary gripper set 18 is unobstructed. Furthermore, the structures holding these elements in position permit the stock to be lowered vertically into and raised vertically from the zone of the grippers 17, 18. The draw die 126 and cassette 127 can accommodate such movement, once the stock is threaded into the draw die, by remaining with the stock and by slipping vertically into and out of a receiving pocket 147 on the carriage 128. Loading and unloading of stock vertically in and out of the grippers 17, 18 can result, in some applications, in substantial savings in changeover time.

The disclosed invention, by using identical parts in a stock feed device with or without an optional wire draw device, affords substantial economies in manufacture and inventory.

While the invention has been shown and described with respect to a particular embodiment thereof, this is for the purpose of illustration rather than limitation, and variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. A wire feeding apparatus comprising a frame, a movable set of grippers mounted on said frame for reciprocation in a feed direction, an actuator for opening and closing the movable set of grippers in a gripping direction perpendicular to the feed direction, a drive for reciprocating said movable gripper set along the feed direction, a stationary set of grippers mounted on said frame stationarily with respect to the feed direction, an actuator for opening and closing the stationary set of grippers in a gripping direction perpendicular to the feed direction, said frame and at least one of said set of grippers being arranged, for loading of a new length of wire stock, to recieve such wire stock in a loading direction generally perpendicular to said feed direction and generally perpendicular to the opening and closing direction of said one of said grippers, a draw die on said frame and support means on said frame for receiving said draw die in an operative position by movement thereof in said loading direction.

2. Wire feeding apparatus as set forth in claim 1, wherein said apparatus is arranged with both of said gripper sets to be loaded with wire stock in said loading direction.

3. Wire feeding apparatus as set forth in claim 2, wherein said frame and gripper sets are arranged such that the feed direction is generally horizontal and said loading direction is generally vertical.

4. Wire feeding apparatus as set forth in claim 1, wherein said driver includes a mechanism to adjust the feed stroke of the moveable set of grippers.

5. Wire feeding apparatus as set forth in claim 4, wherein said driver includes a pivotal lever and said adjustment mechanism includes a slider block carried on said lever.

6. Wire feeding apparatus as set forth in claim 1, wherein said actuators are hydraulic piston and cylinder units.

7. Wire feeding apparatus as set forth in claim 2, wherein said gripper sets have V-groove operating faces.

8. A wire feeding apparatus comprising a frame, a moveable set of grippers mounted on said frame for reciprocation in a feed direction, an actuator for opening and closing the moveable set of grippers in a gripping direction perpendicular to the feed direction, a drive for reciprocating said moveable gripper set along the feed direction, a stationary set of grippers mounted on said frame stationarily with respect to the feed direction, an actuator for opening and closing the stationary set of grippers in a gripping direction perpendicular to the feed direction, said frame and at least one of said set of grippers being arranged, for loading of a new length of wire stock, to receive such wire stock in a loading direction generally perpendicular to said feed direction and generally perpendicular to the opening and closing direction of said one of said grippers, said actuators being hydraulic piston and cylinder units, and including spring loaded guide rollers associated with the moveable gripper set for retracting the associated hydraulic actuator.

9. A wire feeding apparatus comprising a frame, a moveable set of grippers mounted on said frame for reciprocation in a feed direction, an actuator for opening and closing the moveable set of grippers in a gripping direction perpendicular to the feed direction, a drive for reciprocating said moveable gripper set along the feed direction, a stationary set of grippers mounted on said frame stationarily with respect to the feed direction, an actuator for opening and closing the stationary set of grippers in a gripping direction perpendicular to the feed direction, said frame and at least one of said set of grippers being arranged, for loading of a new length of wire stock, to receive such wire stock in a loading direction generally perpendicular to said feed direction and generally perpendicular to the opening and closing direction of said one of said grippers, a draw die on said framer for drawing wire being fed, the hydraulic actuator associated with the stationary gripper set being an arrangement of a relatively small fast operating hydraulic actuator and a relatively large hydraulic actuator.

10. Wire feeding and drawing apparatus having a frame, and having arranged on the frame in the following spatial relation along a feed direction, a die, a moveable gripper set and a stationary gripper set, an actuator for opening and closing the moveable gripper set and an actuator for opening and closing the stationary gripper set, a drive for reciprocating the moveable gripper set in the feed direction, the draw die, the moveable gripper set and the stationary gripper set being arranged to feed stock when the moveable gripper set is driven in a forward direction by the drive and to draw stock when the moveable gripper set is driven in a reverse direction by the drive.

11. Wire feeding and drawing apparatus as set forth in claim 10, wherein the drive is arranged to relieve the tension in the wire before the moveable gripper set grips the wire.

12. Wire feeding and drawing apparatus as set forth in claim 10, wherein the actuator for the stationary gripper set has a relatively small fast operating hydraulic piston and cylinder and a relatively large piston and cylinder.

13. Wire feeding and drawing apparatus as set forth in claim 12, wherein said small and large piston and cylinders are arranged in tandem in a manner wherein the large piston applies a mechanical force to the stationary gripper set through the small piston.

14. Wire feeding and drawing apparatus as set forth in claim 12, wherein said small piston and cylinder can be utilized with substantially no change to its interrelationship with the stationary gripper set when the draw die and large piston and cylinder are omitted to provide a wire feed device.

15. Wire feeding and drawing apparatus as set forth in claim 10, wherein said frame and gripper sets are arranged to receive and release wire stock for stock loading and unloading purposes in a direction generally perpendicular to the stock feeding direction.

16. Wire feeding and drawing apparatus as set forth in claim 15, wherein said frame and gripper sets accommodate loading and unloading motion in a generally vertical direction.

17. Wire feeding apparatus as set forth in claim 10, wherein the drive includes a pivotal lever and a slide on the lever to adjust the length of the feed stroke.

18. Apparatus for feeding wire stock and drawing the stock comprising a frame, a stationary set of grippers, a moveable set of grippers and a draw die receiving area, a drive for reciprocating the moveable set of grippers and the draw die receiving area in a feed direction, an actuator for opening and closing the moveable set of grippers, an actuator for opening and closing the stationary set of grippers, the stationary gripper set actuator including a relatively small hydraulic piston and cylinder unit capable of accurately holding stock in position while the moveable set of grippers is open and returning to a stock pick-up position, said moveable set of grippers and relatively small piston and cylinder being arranged to accommodate the installation of a relatively large piston and cylinder and work in conjunction therewith to hold stock against drawing forces where a draw die is employed in said draw die zone.

19. Apparatus for feeding wire stock as set forth in claim 18, wherein said relatively small piston is arranged to mechanically transmit the force developed by said relatively large piston and cylinder to said stationary set of grippers.

20. Wire feeding and drawing apparatus including a draw die, a moveable set of grippers and a stationary set of grippers, actuators for opening and closing the moveable set of grippers and the stationary set of grippers respectively, the stationary set of grippers actuator including a relatively small hydraulic piston and cylinder and a relatively large hydraulic piston and cylinder, the relatively small piston and cylinder having a fast response to enable wire stock to be adequately gripped during feeding operations at relatively high machine speed and the relatively large piston and cylinder having the capacity to hold the stock against drawing forces.

21. Wire feeding and drawing apparatus as set forth in claim 20, wherein the relatively small piston is arranged to mechanically transmit the hydraulic force developed by the relatively large piston to the stationary set of grippers.

* * * * *

UNITED STATES PATENT AND TRADEMARK OFFICE

CERTIFICATE OF CORRECTION

PATENT NO. : 5,724,847

DATED : March 10, 1998

INVENTOR(S) : William H. Hite

It is certified that error appears in the above-indentified patent and that said Letters Patent is hereby corrected as shown below:

On the cover page, Section [56], insert the following references:

| | | | |
|---|---|---|---|
| --2,698,081 | 12/1954 | Rice | 226/167 |
| 2,728,447 | 12/1955 | Ware | 72/285 |
| 3,273,372 | 09/1966 | Ehlert | 72/285 |
| 3,654,784 | 04/1972 | Alcock | 72/285 |
| 3,735,907 | 05/1973 | Kuchar | 226/162 |
| 4,127,999 | 12/1978 | Lorenz | 72/290 |
| 4,290,541 | 09/1981 | Scribner | 226/162 |
| 4,580,710 | 04/1986 | Ledgerwood | 226/150-- |

Signed and Sealed this

Twenty-third Day of June, 1998

Bruce Lehman

*Attest:*

BRUCE LEHMAN

*Attesting Officer*

*Commissioner of Patents and Trademarks*